United States Patent [19]

Glaser et al.

[11] 4,026,139

[45] May 31, 1977

[54] METAL SURFACE REPAIR TOOL

[75] Inventors: Max Glaser; Hyman Glaser, both of San Diego; Elmer Glaser, Oceanside; Dennis Glaser; Donald Glaser, both of San Diego, all of Calif.

[73] Assignee: The Raymond Lee Organization, Inc., New York, N.Y. ; a part interest

[22] Filed: Jan. 21, 1976

[21] Appl. No.: 650,946

[52] U.S. Cl. ..... 72/389; 72/458; 72/465; 72/705

[51] Int. Cl.[2] ..... B21D 1/12

[58] Field of Search ..... 72/705, 389, 479, 458, 72/465, 309

[56] References Cited

UNITED STATES PATENTS

| | | | |
|---|---|---|---|
| 2,696,240 | 12/1954 | Crowder | 72/705 |
| 2,749,795 | 6/1956 | Boykin | 72/458 |
| 2,949,144 | 8/1960 | Dredske | 72/458 |
| 3,091,983 | 6/1963 | Kliss | 72/458 |
| 3,712,106 | 1/1973 | Holsapple | 72/458 |

*Primary Examiner*—C.W. Lanham
*Assistant Examiner*—Gene P. Crosby
*Attorney, Agent, or Firm*—Howard I. Podell

[57] ABSTRACT

A portable hand held tool for restoring the surface of a metal sheet such as the body skin of a vehicle from a dented condition. The tool is in the form of a pair of levers pivotably joined at their mid-section together and to an arm that extends from the pivoted joint. One free end of the arm is fitted with a suction cup and one end of each lever is fitted with a cushion pad or a suction cup so that with the pads pressed against a dented sheet at opposed boundary sections of the skin adjacent the dent, and the arm suction cup pressed against the dented section, manual movement of the levers will pull the dented section into the plane of the remainder of the skin.

3 Claims, 3 Drawing Figures

METAL SURFACE REPAIR TOOL

SUMMARY OF THE INVENTION

Our invention is a portable hand held tool for restoring the surface of a metal sheet such as the body skin of a vehicle from a dented condition. The tool is in the form of a pair of levers pivotably joined at their mid-section together and to an arm that extends from the pivoted joint. One free end of the arm is fitted with a suction cup and one end of each lever is fitted with a cushion pad or a suction cup so that with the pads pressed against a dented sheet at opposed boundary sections of the skin adjacent the dent, and the arm suction cup pressed against the dented section, manual movement of the levers will pull the dented section into the plane of the remainder of the skin.

BRIEF DESCRIPTION OF THE DRAWINGS

The objects and features of the invention may be understood with reference to the following detailed description of a illustrative embodiment of the invention, taken together with the accompanying drawings in which.

DESCRIPTION OF THE PREFERRED EMBODIMENT

Figure 1:
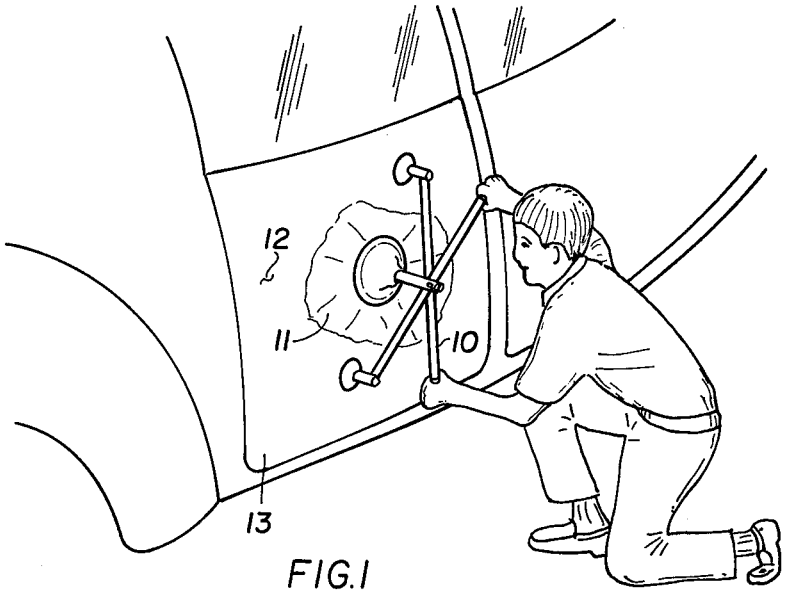
FIG. 1 is a perspective view of the tool in use.
Figure 2:
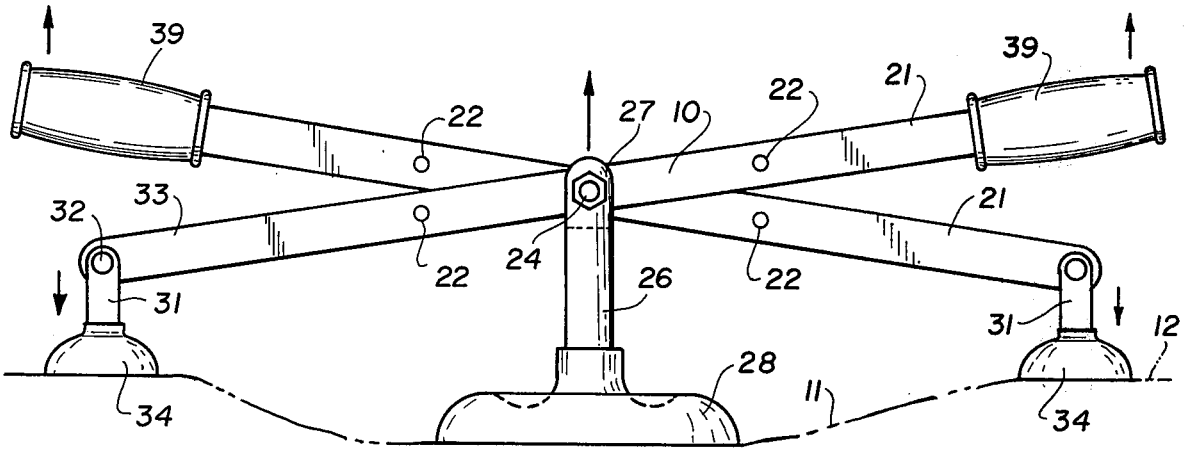
FIG. 2 is a side view of the tool.
Figure 3:
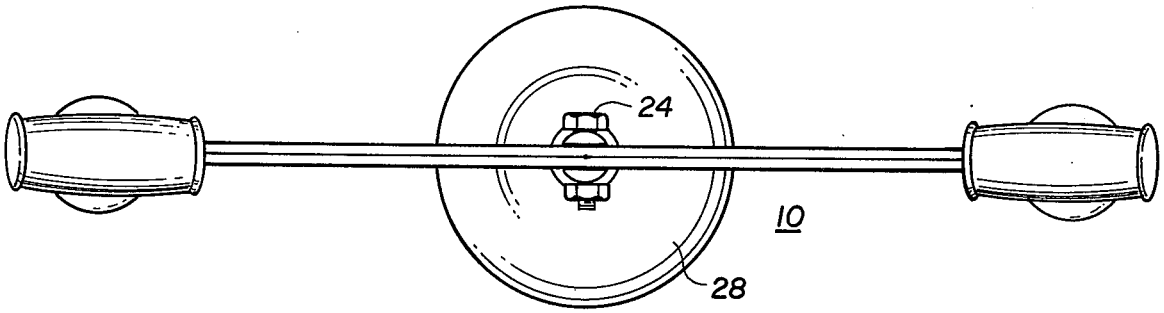
FIG. 3 is a plan view of the tool.

Turning now descriptively to the drawings, in which similar reference characters denote similar elements throughout the several views, FIGS. 1–3 illustrate the repair tool 10 which may be employed to bring a dented concave section 11 or convex section of the exterior skin sheet 12 of the body of a vehicle 13 back to its original shape.

Tool 10 is formed of a pair of levers 21 each fitted with one or more holes 22 in the mid-section of the tool through which a bolt 24 may form a pivotably joint. An arm member 26 is formed as a U-shaped fork section 27 at one end fitted with a suction cup 28 at the other end, with fork section 27 pivotably joined by bolt 24 and fitted about joined levers 21.

A short leg 31 is pivotably bolted by bolt 32 to an end section 33 of each lever 21 with a cushion pad or suction cup 34 fitted to the free end of each leg 31, with both legs preferably of the same length. Pad or cup 34 prevents the device from slipping when using handles 21, with pad or cup 34 bearing against the surface 12 on opposed sides of dented surface 11 as shown in FIG. 2.

Levers 21 may be each fitted with a handle grip 39 at their free ends.

In use, suction cup 28 is anchored to the surface of a dented section 11 of a skin sheet of a vehicle and torque is manually applied to both handles 39 of the two levers 21, with flexible suction cups 34 pressed against opposed sections of the body skin 12 bounding the dented section 11 so as to bring the dented section 11 back to the general plane of the boundary sections or to the continuation of the curved surface of the boundary sections 12 as the case may be.

With cushion pads fitted to the legs 31, the tool may only be employed for restoring a concave dent.

The alternate use of holes 22 permits adjustment of the distance of each leg 31 from arm 26 and flexible suction cup 28.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what we claim as new and desire to secure by Letters Patent of the United States is:

1. A portable tool for removing a dent from a section of a sheet such as the body sheet of a vehicle comprising a pair of levers mounted together by a rotatable joint at a distance from either end of each lever, an arm member pivotably mounted to the joint of the levers, a leg section pivotably mounted to a first end of each lever, said leg section terminating in a cushioned pad, with a suction cup fitted to the end of the arm member.

2. The combination as recited in claim 1 with a handle grip mounted on the second end of each lever arm.

3. The combination as recited in claim 1 in which the cushioned pad at the first end of each lever is in the form of a suction cup.

* * * * *